US005758967A

United States Patent [19]

King

[11] Patent Number: 5,758,967

[45] Date of Patent: Jun. 2, 1998

[54] NON-CLOGGING MOTIONLESS MIXING APPARATUS

[75] Inventor: Leonard Tony King, Long Beach, Calif.

[73] Assignee: Komax Systems, Inc., Wilmington, Calif.

[21] Appl. No.: 177,243

[22] Filed: Jan. 4, 1994

Related U.S. Application Data

[63] Continuation-in-part of Ser. No. 49,977, Apr. 19, 1993, abandoned.

[51] Int. Cl.[6] ..... B01F 5/00

[52] U.S. Cl. ..... 366/337; 138/39

[58] Field of Search ..... 366/336, 337, 366/338, 340; 138/37–39; 48/189.4

[56] References Cited

U.S. PATENT DOCUMENTS

| | | | |
|---|---|---|---|
| 1,632,888 | 6/1927 | Davis et al. . | |
| 3,051,453 | 8/1962 | Sluijters . | |
| 3,457,982 | 7/1969 | Sephton . | |
| 3,751,009 | 8/1973 | Archer . | |
| 3,923,288 | 12/1975 | King . | |
| 4,034,964 | 7/1977 | Larson . | |
| 4,072,296 | 2/1978 | Doom | 366/337 |
| 4,258,782 | 3/1981 | Kao | 138/38 X |
| 4,487,510 | 12/1984 | Buurman et al. | 366/337 |
| 4,623,521 | 11/1986 | Gravley et al. | 138/37 X |
| 4,643,584 | 2/1987 | Allocca | 366/337 |
| 4,692,030 | 9/1987 | Tauscher et al. | 366/337 |
| 4,758,098 | 7/1988 | Meyer | 366/337 |
| 4,865,460 | 9/1989 | Friedrich | 366/337 |
| 4,936,689 | 6/1990 | Federighi et al. | 366/337 |

FOREIGN PATENT DOCUMENTS

| | | | |
|---|---|---|---|
| 24309 | 3/1914 | Norway | 366/337 |

*Primary Examiner*—Charles E. Cooley
*Attorney, Agent, or Firm*—Malcolm B. Wittenberg

[57] ABSTRACT

A stationary material mixing apparatus in the shape of a cylindrical conduit being open at both ends. The conduit houses a plurality of mixing elements which are characterized as having no edges perpendicular to the longitudinal axis and which are sized and positioned within the conduit such that at any plane passing perpendicularly to the longitudinal axis, at least 75% of the circumference of the conduit is free of any mixing element.

6 Claims, 8 Drawing Sheets

NON-CLOGGING MOTIONLESS MIXING APPARATUS

RELATED APPLICATIONS

The present application is a continuation-in-part of U.S. application Ser. No. 08/049,977 filed on Apr. 19, 1993, now abandoned.

TECHNICAL FIELD OF THE INVENTION

The present invention is directed to a material mixing apparatus which contains various elements traditionally known as static mixers for mixing various components of a fluid stream. The present mixer is distinguished in being of a non-clog design.

BACKGROUND OF THE INVENTION

It has long been realized that static mixers which are made to work efficiently provide a certain economic advantage over dynamic mixers. Static mixers employ no moving parts and, as such, are generally considered less expensive to configure and certainly much less expensive to maintain while providing the user with an extended life for the mixer product in service.

There have been a number of prior approaches taken to the design and implementation of static mixers. They generally involve the machining, molding, casting or other fabrication of components which are coupled by some type of permanent attachment means to a conduit sidewall. Although some designs work better than others, virtually all prior devices can be characterized as having certain "dead zones." In these areas, fluids, even in turbulent flow, accumulate and remain virtually unmixed. Also, when dealing with certain types of effluent streams, the various static mixing elements can act to entrap or entangle portions of the fluid stream which can result in a clogging or plugging of the conduit in its entirety.

Static or motionless mixers are in common use in industrial process applications that include heat transfer, chemical reactions, plastic coloration and water treatment, among others. Mixers of this type are installed in process pipelines and handle flowing materials under both laminar and turbulent flow conditions generally on a continuous rather than batch process basis.

In fact, it is well known that an extended length of pipe can be used to mix fluids. See *Chemical Engineering Handbook*, 5th Edition, pgs. 21–24 and 21–26. Reynolds numbers must be high enough to assure turbulence and pipe lengths of the order of 100 pipe diameters or more are usually required. The energy necessary to achieve mixing comes with the pressure drop required to move the fluids through the pipe.

Pressure drop calculations are made using the Fanning or Darcy Weisbach equation which involves the use of a friction factor multiplier "f". See *Chemical Engineering Handbook*, 5th Ed., pgs. 5–21 and 5–22. The friction factor can be related to the amplitude of the roughness of the pipe inside wall relative to the pipe diameter and to the Reynolds number. Values for f are typically in the range of 0.01 to 0.05. As noted by the following discussion, long lengths of pipe required to effect mixing represent uneconomical and physically unattractive options.

At very low flow rates in an open pipe, fluid flows in a laminar fashion. This can easily be seen in dye traced experiments. As one slowly increases the flow rate from 0 to a higher value, turbulence begins to occur at the rough pipe walls. The fluid near the center of the pipe, however, continues to move in a laminar fashion. It is not until higher velocities are achieved that turbulence is encountered at the pipe center. Even at this stage, complete mixing is not realized with radial transfer across the pipe diameter which can be clearly seen in dye traced experiments. This effect has come to be known as turbulaminar flow.

The effects noted above occur in a circularly symmetrical fashion. In other words, because a pipe is normally rough at all points around its periphery, the zone of relatively laminar flow near the pipe's center is also circularly symmetrical. As such, it was hypothesized that to improve the mixing efficiency of a pipe, it would be necessary to increase the effective roughness of the pipe in a non-symmetrical fashion without major obstruction to the flow of large debris items entrained in the flow.

As noted above, fluid flow in a tube or pipe can either be laminar or turbulent. In laminar flow, fluid moves in a streamline fashion. In turbulent flow, the fluid is characterized as having many large and small eddies and vortices. These result in a mass transfer and exchange both radially and longitudinally in the pipe and therefore contribute to mixing.

The Reynolds number can be calculated according to the following equation:

$$Re=3157\ QS/ud$$

wherein:

Q=the flow rate of fluid in US gal/min.

S=specific gravity (water=1)

u=fluid viscosity in centipoise d=pipe inside diameter in inches

The value of Re for transition from laminar to turbulent flow is usually accepted as being about 2,000. Below 2,000, flow is generally always laminar. When the Reynolds number reaches 4,000, the fluid is in turbulent flow.

Flow mechanisms in laminar and turbulent flow are quite different. In laminar flow, viscous forces which restrict flow and result in a pressure drop across the mixing device are proportional to the flow rate Q. In turbulent flow, the major resistance to fluid flow results from internal forces required to produce eddies and vortices, and the pressure drop is proportional to the flow rate Q squared.

The above-recited factors must be taken into account when designing a motionless mixer handling both laminar and turbulent flow applications. In laminar flow, fluid flow must be divided, reoriented and recombined so as to produce a large number of striations. The result is a large interfacial area between components which enhances molecular diffusion. By contrast, in turbulent flow mixing, the creation of vortices is encouraged to provide the opportunity for fluid components to interact with each other so as to produce smaller eddies or vortices so as to randomize distribution of flow components. As such, laminar flow mixing depends upon the systematic division and reassembly while turbulent flow mixing relies upon chaotic mechanisms.

In creating a static or motionless mixer, at least four objectives are sought:

1. Turbulent flow is encouraged at low Reynolds numbers so as to encourage mixing at low flow rates.
2. The mixing device should be as short as practicable.
3. The mixer should be relatively free from "plugging effects" from materials such as fiber, clumps and particulates often present in pipe lines.
4. The pressure drop should be as low as possible.

It has further been observed that if a design is effective under laminar flow conditions, it is invariably effective for turbulent flow. On the other hand, if a design is effective for turbulent flow, it is not necessarily effective for laminar flow. It is also noted that when a motionless mixer is installed in a pipe, the Reynolds number at which turbulence and therefore mixing occurs will be lower. In fact, primitive motionless mixers consisted of a pipe filled with chain or ball bearings. However, such configurations resulted in a high pressure drop and were very susceptible to plugging.

To reiterate, it was determined that the effective roughness of the interior wall of the pipe should be increased to enhance mixing efficiency. However, it further remained a design priority to increase a pipe's effective roughness without major obstruction to the flow of large debris items entrained in a process or flow system. Both design parameters have been achieved in practicing the present invention described below.

It is thus an object of the present invention to provide a stationary material mixing apparatus capable of producing turbulent flow at relatively low Reynolds numbers, to be as short as practical, to be free from plugging effects from materials such as fibers, clumps and particulates and to produce a relatively low pressure drop.

These and further objects will be more readily apparent when considering the following disclosure and appended drawings wherein.

SUMMARY OF THE INVENTION

The present invention is directed to a stationary material mixing apparatus which comprises a conduit having a length, longitudinal axis through said length and which is open at both ends. The conduit houses a plurality of mixing elements whereby said elements are characterized as having no edges or surfaces substantially perpendicular to the longitudinal axis. The mixing elements are further characterized as being positional within the conduit such that at least 75% of the conduit's circumference in any plane is free of any ancillary structure resulting in an open region of travel for fluids passing through said conduit along its longitudinal axis.

Figure 1:
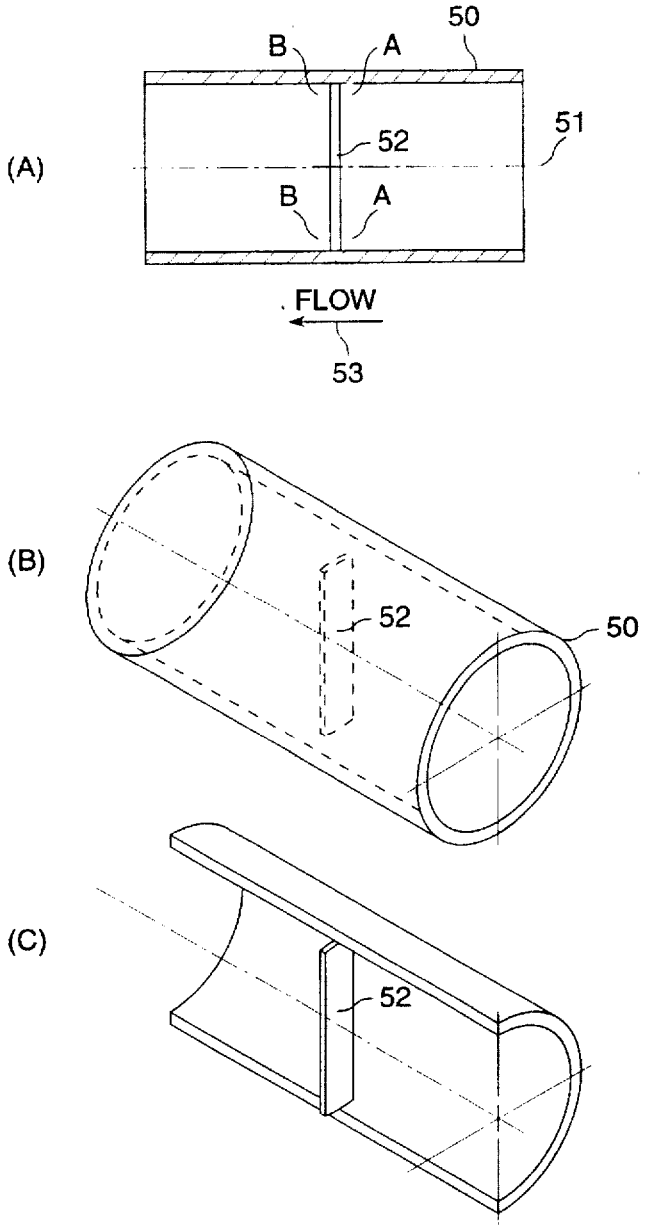
FIG. 1 PRIOR ART
FIGS. 1 through 6 represent prior art approaches to static mixer design.
Figure 2:
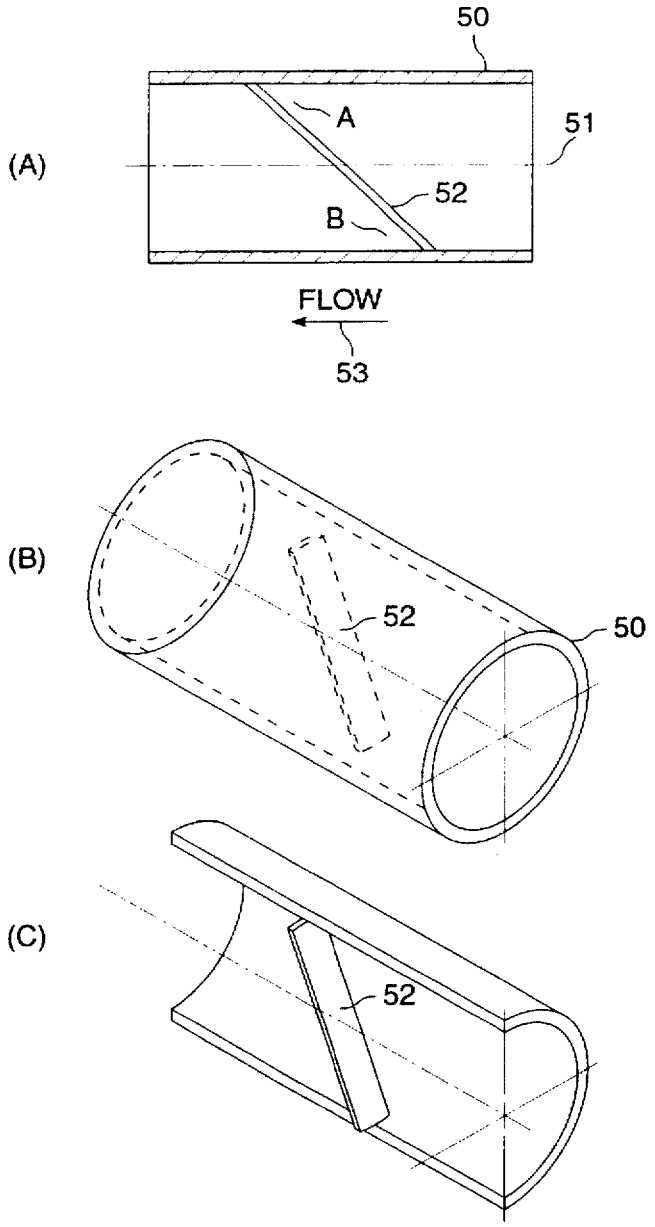
FIG. 2 PRIOR ART

FIGS. 1 and 2 are related wherein, in each instance, conduit 50 is provided with a simple plate or bar 52 diametrically within conduit 50 having longitudinal axis 51. In each instance, this simplistic mixing device is shown in FIG. 1/FIG. 2 (A) in cross-section, in FIG. 1/FIG. 2 (B) in perspective and in FIG. 1/FIG. 2 (C) in partial or cut-away perspective.

In FIG. 1, mixing bar 52 is shown to be perpendicular to longitudinal axis 51 while in FIG. 2, the same bar is positioned at an angle to longitudinal axis 51. Regardless, at region A, a "crotch" is formed where fibrous material can gather and "hang up." Also, at region B, a low pressure point or "dead spot" is created which further encourages the accumulation of material. This can be disastrous in a reactor application where a long residence time can result in material degradation.

Figure 3:
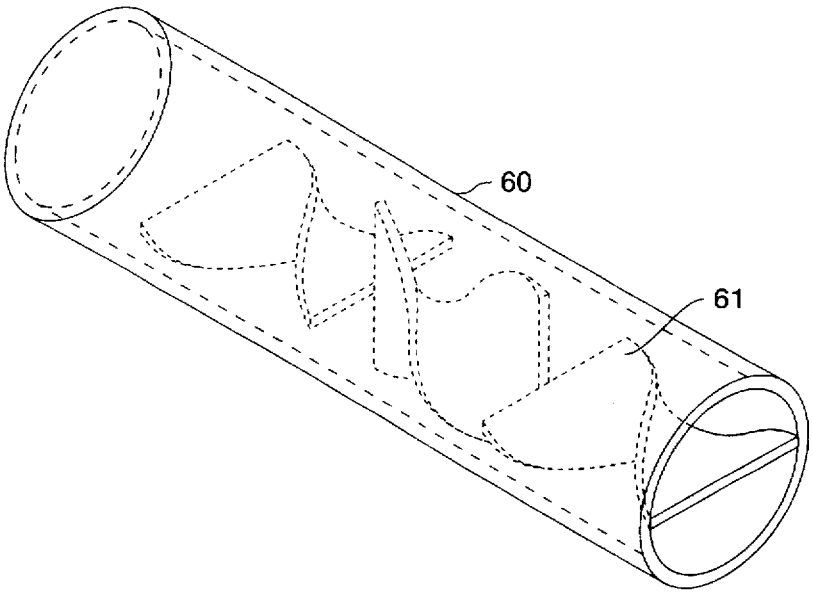
FIG. 3 PRIOR ART

One of the earlier practical static mixers was disclosed is U.S. Pat. No. 3,051,453, the perspective view of which is shown in FIG. 3. In this instance, conduit 60 houses axially overlapping mixing elements 61. Although this design produces turbulent flow in relatively low Reynolds numbers, can be made relatively short and still adequately function while producing fairly low pressure drops, the structure is not capable of resisting plugging effects when materials such as fibers, clumps and particulates are contained in the fluid stream.

Figure 4:
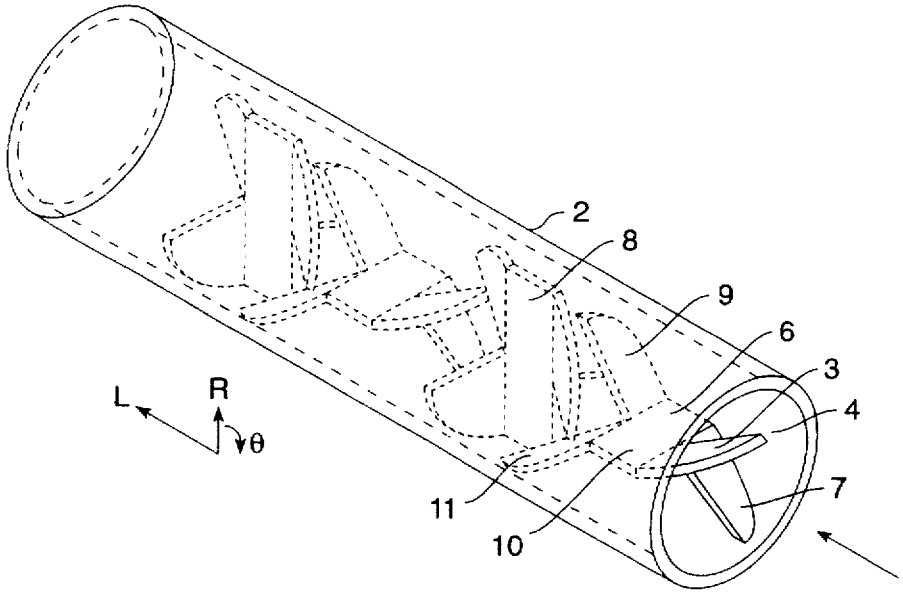
FIG. 4 PRIOR ART

FIG. 4 represents applicant's prior design made the subject of U.S. Pat. No. 3,923,288. In this instance, conduit 2 is fitted with self-nesting, abutting and axially overlapping elements 4. These elements tend to self-align, abut and nest within adjacent elements and provide a close fit to the conduit sidewalls when a slight "spring" is provided in the elements. Elements 6 and 8 are mirror images of one another and each includes a central flat portion 10, the plane of which is intended to be centrally aligned with the longitudinal axis of conduit 2. Each element is also provided with first and second ears 3 and 7 rounded or otherwise configured at their outside peripheries for a general fit to the wall of conduit 2 and are bent up and down from flat portion 10. The second pair of ears 9 and 11 are configured at the opposite side of flat portion 10 and are bent downward and upward as well. Again, such a mixing device meets virtually all of the above-described design criteria except for the fact that it is incapable of resisting clogging or plugging when fibers, clumps and particulates are contained within fluids to be mixed.

Figure 5:
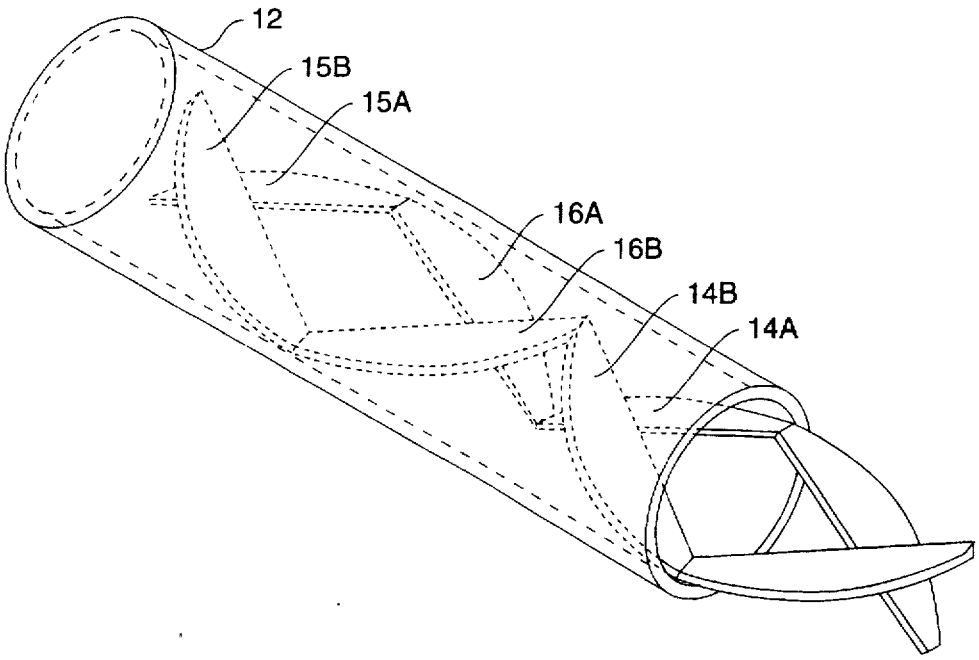
FIG. 5 PRIOR ART

FIG. 5 represents yet a further approach to static mixer design. This configuration was made the subject of U.S. Pat. No. 4,936,689. In this instance, conduit 12 houses mixing element 14 which in turn comprises two segments 14A, 14B of a specific configuration which can be formed from flat sheets of stock material. After the two segments 14A and 14B have been formed, they are inserted into conduit 12 in a radially spaced relationship providing a gap there between (not shown) and are secured therein. However, unlike the present invention, individual flat plates 15A and 15B are attached to adjacent flat mixing plates 16A and 16B which produce a series of "crotches" which clearly encourage clogging.

Figure 6:
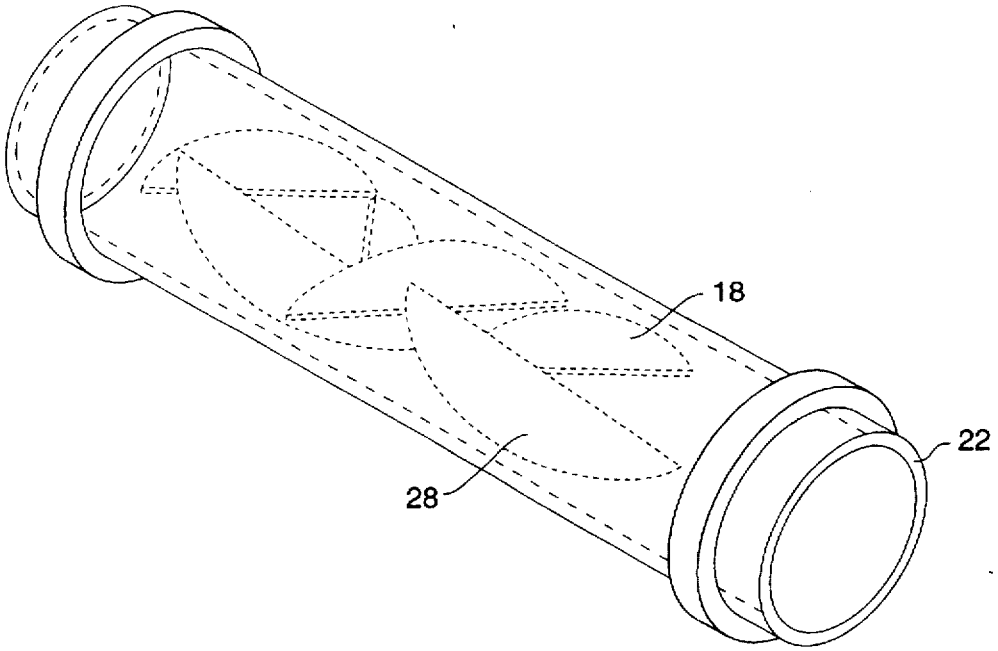
FIG. 6 PRIOR ART

FIG. 6 represents yet another prior approach to static mixing. Specifically, the configuration of FIG. 6 has been made the subject of U.S. Pat. No. 4,643,584. In this instance, conduit 12 houses individual baffle elements 18 and 28 disposed at an angle to the central axis of the conduit extending and overlapping plate elements of adjacent pairs. Although this configuration has been characterized as "non-plugging," it has been found that this configuration is anything but "non-plugging." Specifically, plate elements 18 and 28 are taught to be secured together in a defined configuration by a variety of means such as by welding at a midpoint of the major axis of an elliptical edge of one plate to the edge of an adjacent plate. As such, "crotches" are formed at each weld point of each plate element pair. This clearly encourages the hangup of fibrous material often contained in fluid streams.

Figure 7:
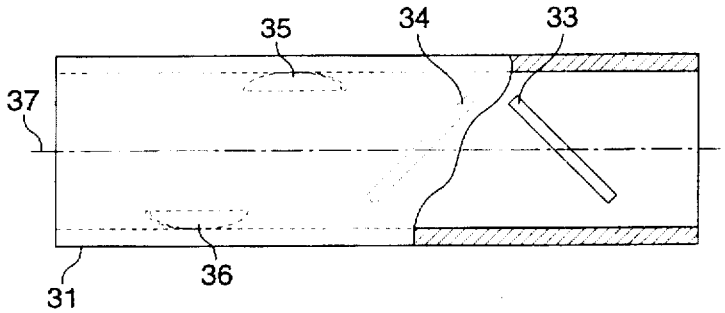
FIG. 7 represents the present invention in partially cut-away plan view.
Figure 8:
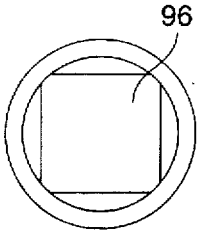
FIG. 8 represents the present invention in end view.
Figure 9:
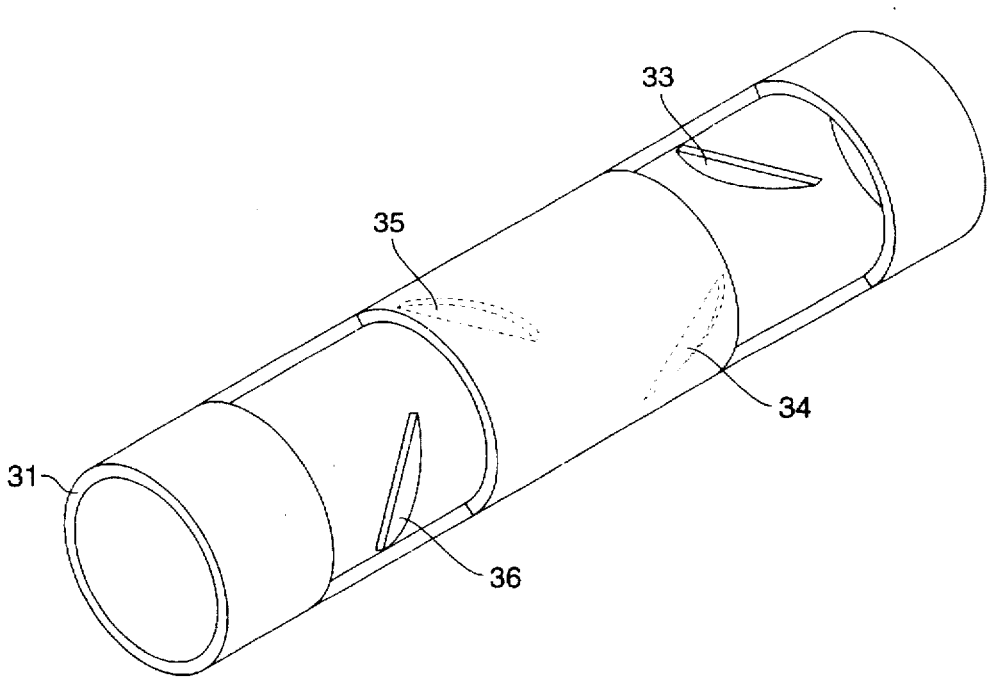
FIG. 9 represents the present invention in perspective view.

By contrast, reference is made to FIGS. 7, 8 and 9 whereby the present material mixing apparatus is shown in the form of conduit 31 having a substantially circular cross-section (FIG. 8). Conduit 31 being in the shape of a cylinder is provided with longitudinal axis 37. End flanges (not shown) can be provided to enable the stationary material mixing apparatus of the present invention to be joined with adjacent conduit for carrying and directing a stream of fluids to be mixed.

As noted, the present stationary material mixing apparatus is provided with mixing elements 33, 34, 35 and 36. These elements are characterized as having no edges or surfaces perpendicular to longitudinal axis 37 and are sized so that no such elements are in contact with one another resulting in an open region of travel 96 for fluids passing through conduit 31 along its longitudinal axis ideally, each mixing element is seated within the conduit at an angle between approximately 30° to 45° to said longitudinal axis. Most importantly, however, the mixing elements are positioned within the conduit so that at least 75% of the conduit circumference in any plane is free of any mixing element. Obviously, various mixing elements are provided with no points of contact so that there are absolutely no "crotches" provided in the present invention which would otherwise result in material hangup. In fact, it is a design objective of the present invention to enable debris having effective diameters of 75% or more of the conduit diameter to pass through the conduit without entrainment.

Although the mixing device shown in FIG. 7 can be used for mixing fluids such as gases, liquids and solids and combinations of such materials, the genesis of the present invention is the result of activities conducted in the sewage treatment field. Such mixers are used to combine dewatering agents with sewage flow just upstream of a filter press. Virtually all previous static mixers, and specifically those depicted in FIGS. 1 through 6, eventually plug or clog in this application. Material will migrate to and accumulate in low pressure or "dead spots" and long fibers will catch and build up in "crotches." Both of these effects allow and encourage more material to accumulate until the mixer finally plugs. By providing spacing 96 and more importantly by providing the placement of mixing elements whereby at least 75% of the conduit circumference in any plane is clear of any ancillary structure accomplishes the goals of the present invention. Even the most problematic components "slide" over the mixing elements without clogging under both laminar and turbulent flow conditions.

Ideally the mixing elements are provided as pairs such as 33/34 and 35/36. Each complementary pair cause flowing material to rotate about the axis of the conduit in opposite directions.

FIGS. 7 to 9 clearly depict a new mixing concept where four mixing elements are shown of a circular segment configuration each of a height approximately D/10 and a radius of D/2, wherein D is the diameter of the conduit. The various mixing segments or elements are set in a non-opposing fashion at the pipe wall so as to present to the fluid at any plane normal to the axis of the conduit a non-symmetrical cross-section. This serves to break up the normal circular symmetry of flow and to substantially reduce the conduit length necessary to achieve effective mixing. As such, mixing is accomplished with less of a pressure drop than would be required to obtain a given degree of mixing with an open pipe which is coupled with the ability of the present mixer to pass an object which is large compared to the inside diameter of the conduit.

In order to test this design approach, a 13.5 ft. length of 1½ inch schedule 40 pipe having a nominal inside diameter of 1.61 inches was provided. A clear acrylic tube was mounted at the exit of the pipe whereby food coloring dye having a viscosity of 6 cp was injected with water at the pipe inlet. Pressure drop with a flow of 10 gpm was measured at 10.2 inches of water or 0.37 psi. It was observed that striations of food coloring material were clearly visible at the pipe exit through the acrylic tube wall.

Next, a model of the present invention was fabricated having the same pipe diameter as in the above test and mounted in the same test set-up. In this instance, however, the pipe was 7 inches long and had four of the described mixing elements installed as illustrated in FIG. 7. Again, at the device exist, a section of clear acrylic tubing was mounted to allow observation of the mix quality. The pressure drop at the same flow rate of 10 gpm was measured as 3.5 inches of water or 0.13 psi. The quality of the output mixture in terms of both dispersion and distribution was judged to be excellent. As noted, enhanced mixing was achieved at a pressure drop of about one-third of that experienced and in using the open pipe mixer.

The ability of the present invention to pass an object therethrough was next tested. In this instance, a plastic ball of 1.45 inches in diameter was inserted into the upstream end of the device and the water supply turned on. The ball almost immediately emerged from the exist of the device. This showed that a ball having a diameter of 90% of that of the pipe inside diameter could freely pass therethrough. This was compared to the device shown in U.S. Pat. No. 4,936,689 which completely obstructed any attempt to pass such a plastic ball whatsoever.

I claim:

1. A stationary material mixing apparatus comprising a conduit having a length, a substantially circular circumference, a longitudinal axis through said length and being open at both ends thereof, said conduit housing a plurality of mixing elements, said mixing elements having no edges perpendicular to said longitudinal axis and are sized and positioned within said conduit such that at any plane passing perpendicularly to said longitudinal axis, at least 75% of the circumference of said conduit is free of any mixing element and no mixing elements are in contact with one another resulting in an open region of travel for fluids passing through said conduit along its longitudinal axis.

2. The stationary mixing apparatus of claim 1 wherein said mixing elements are provided in said conduit in complementary pairs, wherein adjacent mixing elements cause fluid passing within said conduit to rotate in opposite directions.

3. The stationary material mixing apparatus of claim 1 wherein each mixing element is seated within said conduit at an angle between approximately 30° to 45° to said longitudinal axis.

4. The stationary material mixing apparatus of claim 1 wherein said mixing elements are in the forms of circular segments wherein each mixing element is characterized as being widest in profile at its midpoint and narrowest at its longitudinal endpoints.

5. The stationary material mixing apparatus of claim 4 wherein each mixing element is of a height equal to approximately D/10 and a radius of approximately D/2 wherein D is the diameter of said conduit.

6. The stationary material mixing apparatus of claim 1 wherein said mixing elements are sized and positioned within said conduit such that said conduit is capable of passing therethrough solid matter having a diameter of at least 75% of the diameter of said conduit.

* * * * *